United States Patent [19]

Uehara et al.

[11] Patent Number: 4,983,112

[45] Date of Patent: Jan. 8, 1991

[54] INTERLOCKING DEVICE FOR HOT ISOSTATIC PRESSURIZING EQUIPMENT

[75] Inventors: Katsuhiro Uehara; Takahiko Ishii; Takao Fujikawa; Kuniaki Kanda, all of Kobe; Yutaka Narukawa, Nishinomiya, all of Japan

[73] Assignee: Kabushiki Kaisha Kobe Seiko Sho, Kobe, Japan

[21] Appl. No.: 382,267

[22] Filed: Jul. 20, 1989

[30] Foreign Application Priority Data

Jul. 30, 1988 [JP] Japan ..... 63-191594
Jan. 21, 1989 [JP] Japan ..... 1-12754

[51] Int. Cl.[5] ..... B22F 3/14

[52] U.S. Cl. ..... 425/136; 419/49; 419/57; 425/78; 425/149; 425/151; 425/153; 425/161; 425/405.2

[58] Field of Search ..... 419/48, 49, 57; 425/136, 143, 149, 151, 153, 161, 405.1, 405.2, 78

[56] References Cited

U.S. PATENT DOCUMENTS 4,032,337 6/1977 Boyer ..... 419/49
4,756,680 7/1988 Ishii ..... 425/405.2

FOREIGN PATENT DOCUMENTS 61-284505 12/1986 Japan ..... 419/49

OTHER PUBLICATIONS

"Metall", 39, edition 10, Oct. 1985, pp. 968–971.
Asea, Vasteras, Sweden, nr. 6735, p. 13.

*Primary Examiner*—Jay H. Woo
*Assistant Examiner*—James P. Mackey
*Attorney, Agent, or Firm*—Oblon, Spivak, McClelland, Maier & Neustadt

[57] ABSTRACT

An interlocking device for a HIP equipment that prevents possible damage to the HIP equipment arising from use of a furnace or processing gas in error and can control the oxygen concentration and pressure within the HIP equipment. The device includes a sensor for detecting a concentration of oxygen in the processing gas in a processing gas pipe system. If the sensor detects an excessively high oxygen concentration, a supply side interlocking mechanism closes a valve for the pipe system and disconnects a power source for a furnace in a high pressure vessel. A flow switch is connected to a safety pipe system having a safety device, and a thermocouple is provided for each of the safety and processing gas pipe systems and a relief pipe system. When the flow switch detects processing gas being spouted from the safety pipe system and/or when one of the temperature signals from the thermocouples exceeds a preset value, a relief side interlocking mechanism closes the processing gas pipe system, opens the relief pipe system, stops a gas compressor and disconnects the power source.

13 Claims, 10 Drawing Sheets

INTERLOCKING DEVICE FOR HOT ISOSTATIC PRESSURIZING EQUIPMENT

BACKGROUND OF THE INVENTION

1. Field of the Invention

This invention relates to an interlocking device for a hot isostatic pressurizing equipment.

2. Description of the Prior Art

A hot isostatic pressurizing equipment (hereinafter referred to simply as HIP equipment) normally performs a processing in an atmosphere of inert gas such as argon or nitrogen. Recently, however, such HIP equipment sometimes employs argon gas mixed with oxygen as a processing gas.

In this instance, since a resistance to oxidation is required in a high temperature atmosphere, a platinum-rhodium alloy furnace or the like is used as a furnace mounted in a high pressure vessel. Meanwhile, such processing gas normally contains less than 20% of oxygen with respect to inert gas such as nitrogen.

On the other hand, a safety valve or a rupture disk is used as a safety device for a normal inert gas atmosphere HIP equipment.

In such a HIP equipment wherein gas mixed with oxygen is used as processing gas, control of a concentration of oxygen and control of a pressure are very important from the point of view of assurance of the safety. This is because, if oxygen of an excessively high concentration should be contained in processing gas in error, the HIP equipment may possibly be damaged, and if a pressure higher than a designed pressure is reached in error, the high pressure vessel or a pipe may possibly be damaged.

Control of an oxygen concentration, however, has not been executed so far. Instead, the internal temperature of a HIP equipment is controlled in order to prevent possible damage to the HIP equipment. Accordingly, there are the following problems.

In particular, in a HIP equipment, a furnace is covered with an insulation mantle so that the temperature within the high pressure vessel may not rise while a thermocouple is located on an inner face of a top closure of the high pressure vessel. Thus, if the insulation mantle is deteriorated and the temperature within the high pressure vessel rises to an extraordinarily high level, this is detected by the thermocouple to turn off power to the furnace.

However, if the concentration of oxygen in processing gas is high, then there is the possibility that a seal and a packing may be oxidized (burnt) by a rise of the internal temperature of the high pressure vessel. Accordingly, only turning off the power to the furnace in response to detection by the thermocouple may be too late for prevention of oxidation of a seal or a packing.

Further, in processing in an inert gas atmosphere, if a larger amount of oxygen than an allowable level is contained in processing gas, a graphite furnace or a molybdenum furnace will be worn by oxygen.

To the contrary, control of pressure within a HIP equipment has the following problems.

In particular, in a HIP equipment, a safety valve or a rupture disk is provided to relieve a pressure so that the pressure within the high pressure vessel may not exceed a predetermined designed pressure level.

However, if a higher pressure than the designed pressure level is reached when the concentration of oxygen in processing gas is high, then when a rupture disk is burst to relieve the pressure, a large amount of gas will be discharged at a time. Accordingly, there is the possibility that a pipe may be fired by some factor. It can be considered that the danger increases particularly where the temperature of the pipe is raised during such discharging of gas.

DISCLOSURE OF THE INVENTION

It is an object of the present invention to provide an interlocking device for a hot isostatic pressurizing equipment which stops, when oxygen of a concentration higher than a predetermined level is contained in processing gas, supply of such processing gas to a high pressure vessel and turns off power to a furnace to prevent possible damage to the HIP equipment.

It is another object of the present invention to provide an interlocking device for a hot isostatic pressurizing equipment which inhibits, when a safety device such as a rupture disk is burst, a large amount of high temperature gas from being discharged at a time and turns off power to a furnace to prevent possible damage to, firing of or catching of fire by the HIP equipment, particularly, a pipe.

In order to attain the above objects, according to one aspect of the present invention, there is provided an interlocking device for a hot isostatic pressurizing equipment which includes a high pressure vessel, a furnace in the high pressure level, a processing gas pipe system for supplying processing gas into the high pressure vessel therethrough, and an opening and closing valve interposed in the processing gas pipe system, the interlocking device comprising a processing gas sampling pipe provided intermediately of the processing gas pipe system, an oxygen concentration sensor provided in the processing gas sampling pipe for detecting a concentration of oxygen in processing gas, and an interlocking means operable when the oxygen concentration sensor detects an oxygen concentration higher than a predetermined level for closing the opening and closing valve in the processing gas pipe system and disconnecting a power source for the furnace in the high pressure vessel.

When processing gas is to be charged into the high pressure vessel, it is supplied from the gas cylinder into the high pressure vessel by way of the processing gas pipe system. Thereupon, part of the processing gas is sampled by the processing gas sampling pipe and a concentration of oxygen in the thus sampled processing gas is detected by the oxygen concentration sensor.

If the value detected by the oxygen concentration sensor is higher than the predetermined level, then the opening and closing valve is closed to close the processing gas pipe system while the power source is disconnected to stop operation of the furnace in the high pressure vessel.

Accordingly, with the interlocking device, possible damage to components of the HIP equipment such as a seal and a packing when the concentration of oxygen in processing gas is excessively high can be prevented.

According to another aspect of the present invention, there is an interlocking device for a hot isostatic pressurizing equipment which includes a first furnace for an oxygen atmosphere, a second furnace for an atmosphere other than an oxygen atmosphere, a high pressure vessel adapted to alternatively receive therein one of the first and second furnaces, a processing gas pipe system for supplying processing gas into the high pressure vessel therethrough, and an opening and closing valve interposed in the processing gas pipe system, the interlocking device comprising a processing gas sampling pipe provided intermediately of the processing gas pipe system, an oxygen concentration sensor provided in the processing gas sampling pipe for detecting a concentration of oxygen in processing gas, a discriminating circuit for making a discrimination between the first and second furnaces, and an interlocking means operable when the oxygen concentration sensor detects an oxygen concentration higher than a predetermined level and the discriminating circuit discriminates the second furnace for closing the opening and closing valve in the processing gas pipe system and disconnecting a power source for the second furnace in the high pressure vessel.

When the second furnace which may be a graphite furnace is to be used, it is placed in position into the high pressure vessel. The graphite furnace is discriminated by the discriminating circuit.

After such charging of the graphite furnace, processing gas is supplied and charged into the high pressure vessel. In this instance, if the concentration of oxygen in processing gas is higher than the predetermined level, then the interlocking means closes the opening and closing valve to close the processing gas pipe system, disconnects the power source to stop operation of the second or graphite furnace, and stops operation of the gas compressor.

Accordingly, with the interlocking device, even if the first or second furnace or processing gas is selectively used in error, possible damage to the HIP equipment can be prevented.

According to a further aspect of the present invention, there is provided an interlocking device for a hot isostatic pressurizing equipment which includes a gas cylinder, a gas compressor, a high pressure vessel, a furnace in the high pressure vessel, a processing gas pipe system for supplying processing gas from the gas cylinder to the high pressure vessel by way of the gas compressor, a relief pipe system connected to the processing gas pipe system between the gas compressor and the high pressure vessel for relieving a pressure to the atmospheric air, a safety pipe system connected to the processing gas pipe system between the gas compressor and the high pressure vessel and having a safety device for being burst, when the pressure within the high pressure vessel rises higher than a predetermined level, to relieve the pressure, the interlocking device comprising a first opening and closing valve provided in the processing gas pipe system between the gas cylinder and the gas compressor, a second opening and closing valve interposed in the relief pipe system, a third opening and closing valve interposed in the safety pipe system, a flow switch provided in the safety pipe system for detecting processing gas being spouted from the safety pipe system when the pressure in the high pressure vessel lowers lower than the predetermined pressure after the safety device has been burst, and an interlocking means operable when the flow switch detects processing gas being spouted from the safety pipe system for closing the first and third opening and closing valves, opening the second opening and closing valve, stopping operation of the gas compressor and disconnecting a power source for the furnace in the high pressure vessel.

When processing gas is to be charged into the high pressure vessel, it is supplied from the gas cylinder into the high pressure vessel by way of the processing gas pipe system by the gas compressor.

If the pressure within the high pressure vessel rises higher than the predetermined level and the safety device is burst, then the flow switch will detect a flow of gas being discharged from the high pressure vessel by way of the safety pipe system and the safety device. Consequently, the interlocking means closes the first and third opening valves to close the processing gas pipe system and the safety pipe system while it opens the second opening and closing valve to open the relief pipe system. The interlocking further stops operation of the gas compressor and disconnects the power source for the furnace.

Accordingly, possible damage to a pipe or the like of the HIP equipment which may be caused by a leakage of a large amount of high temperature oxygen containing gas when the safety device is burst can be prevented.

According to a still further aspect of the present invention, there is provided an interlocking device for a hot isostatic pressurizing equipment which includes a gas cylinder, a gas compressor, a high pressure vessel, a furnace in the high pressure vessel, a processing gas pipe system for supplying processing gas from the gas cylinder to the high pressure vessel by way of the gas compressor, a relief pipe system connected to the processing gas pipe system between the gas compressor and the high pressure vessel for relieving a pressure to the atmospheric air, a safety pipe system connected to the processing gas pipe system between the gas compressor and the high pressure vessel and having a safety device for being burst, when the pressure within the high pressure vessel rises higher than a predetermined level, to relieve the pressure, the interlocking device comprising a first opening and closing valve provided in the processing gas pipe system between the gas cylinder and the gas compressor, a second opening and closing valve interposed in the relief pipe system, a third opening and closing valve interposed in the safety pipe system, a first thermocouple for measuring a temperature of the processing gas pipe system proximate a gas introducing port formed in a closure of the high pressure vessel, a second thermocouple for measuring a temperature of the relief pipe system proximate the second opening and closing valve, a third thermocouple for measuring a temperature of the safety pipe system proximate the safety device, and an interlocking means operable when any one of temperature signals from the first, second and third thermocouples exceeds a preset value for closing the first and third opening and closing valves, opening the second opening and closing valve, stopping operation of the gas compressor and disconnecting a power source for the furnace in the high pressure vessel.

Also with the interlocking device, possible damage to a pipe or the like of the HIP equipment can be prevented similarly.

According to a still further aspect of the present invention, there is provided an interlocking device for a hot isostatic pressurizing equipment which includes a gas cylinder, a gas compressor, a high pressure vessel, a furnace in the high pressure vessel, a processing gas pipe system for supplying processing gas from the gas cylinder to the high pressure vessel by way of the gas compressor, a relief pipe system connected to the processing gas pipe system between the gas compressor and the high pressure vessel for relieving a pressure to the atmospheric air, a safety pipe system connected to the processing gas pipe system between the gas compressor and the high pressure vessel and having a safety device for being burst, when the pressure within the high pressure vessel rises higher than a predetermined level, to relieve the pressure, the interlocking device comprising a first opening and closing valve provided in the processing gas pipe system between the gas cylinder and the gas compressor, a second opening and closing valve interposed in the relief pipe system, a third opening and closing valve interposed in the safety pipe system, a flow switch provided in the safety pipe system for detecting processing gas being spouted from the safety pipe system when the pressure in the high pressure vessel lowers lower than the predetermined pressure after the safety device has been burst, a first thermocouple for measuring a temperature of the processing gas pipe system proximate a gas introducing port formed in a closure of the high pressure vessel, a second thermocouple for measuring a temperature of the relief pipe system proximate the second opening and closing valve, a third thermocouple for measuring a temperature of the safety pipe system proximate the safety device, and an interlocking means operable when the flow switch detects processing gas being spouted from the safety pipe system and any one of temperature signals from the first, second and third thermocouples exceeds a preset value for closing the first and third opening and closing valves, opening the second opening and closing valve, stopping operation of the gas compressor and disconnecting a power source for the furnace in the high pressure vessel.

If the pressure within the high pressure vessel rises higher than the predetermined level and the safety device is burst, then the flow switch will detect a flow of gas being discharged from the high pressure vessel by way of the safety pipe system and the safety device. If any one of temperatures measured by the first, second and third thermocouples presents a higher value than the preset value then, the interlocking means closes the first and third opening and closing valves, opens the second opening and closing valve, stops operation of the gas compressor, and disconnects the power source for the furnace.

Accordingly, also with the interlocking device, possible damage to the HIP equipment and a pipe or the like of the same which may be caused by a leakage of a large amount of high temperature oxygen containing gas when the safety device is burst can be prevented, and a safety device of a very high reliability is provided.

According to yet another aspect of the present invention, there is provided an interlocking device for a hot isostatic pressurizing equipment which includes a gas cylinder, a gas compressor, a high pressure vessel, a furnace in the high pressure vessel, a processing gas pipe system for supplying processing gas from the gas cylinder to the high pressure vessel by way of the gas compressor, a relief pipe system connected to the processing gas pipe system between the gas compressor and the high pressure vessel for relieving a pressure to the atmospheric air, a safety pipe system connected to the processing gas pipe system between the gas compressor and the high pressure vessel and having a safety device for being burst, when the pressure within the high pressure vessel rises higher than a predetermined level, to relieve the pressure, and a first opening and closing valve interposed in the processing gas pipe system, the interlocking device comprising a processing gas sampling pipe connected to the processing gas pipe system between the gas cylinder and the gas compressor, an oxygen concentration sensor provided in the processing gas sampling pipe for detecting a concentration of oxygen in processing gas, a supply side interlocking means operable when the oxygen concentration sensor detects an oxygen concentration higher than a predetermined level for closing the first opening and closing valve in the processing gas pipe system and disconnecting a power source for the furnace in the high pressure vessel, a second opening and closing valve provided in the processing gas pipe system between the gas cylinder and the gas compressor, a third opening and closing valve interposed in the relief pipe system, a fourth opening and closing valve interposed in the safety pipe system, a flow switch provided in the safety pipe system for detecting processing gas being spouted from the safety pipe system when the pressure in the high pressure vessel lowers lower than the predetermined pressure after the safety device has been burst, and a relief side interlocking means operable when the flow switch detects processing gas being spouted from the safety pipe system for closing the second and fourth opening and closing valves, opening the third opening and closing valve, stopping operation of the gas compressor and disconnecting a power source for the furnace in the high pressure vessel.

The interlocking device can thus control the pressure within the HIP equipment in addition to the concentration of oxygen. Accordingly, a very high safety can be attained by the interlocking device.

According to yet a further aspect of the present invention, there is provided an interlocking device for a hot isostatic pressurizing equipment which includes a gas cylinder, a gas compressor, a high pressure vessel, a furnace in the high pressure vessel, a processing gas pipe system for supplying processing gas from the gas cylinder to the high pressure vessel by way of the gas compressor, a relief pipe system connected to the processing gas pipe system between the gas compressor and the high pressure vessel for relieving a pressure to the atmospheric air, a safety pipe system connected to the processing gas pipe system between the gas compressor and the high pressure vessel and having a safety device for being burst, when the pressure within the high pressure vessel rises higher than a predetermined level, to relieve the pressure, and a first opening and closing valve interposed in the processing gas pipe system, the interlocking device comprising a processing gas sampling pipe connected to the processing gas pipe system between the gas cylinder and the gas compressor, an oxygen concentration sensor provided in the processing gas sampling pipe for detecting a concentration of oxygen in processing gas, a supply side interlocking means operable when the oxygen concentration sensor detects an oxygen concentration higher than a predetermined level for closing the first opening and closing valve in the processing gas pipe system and disconnecting a power source for the furnace in the high pressure vessel, a second opening and closing valve provided in the processing gas pipe system between the gas cylinder and the gas compressor, a third opening and closing valve interposed in the relief pipe system, a fourth opening and closing valve interposed in the safety pipe system, a first thermocouple for measuring a temperature of the processing gas pipe system proximate a gas introducing port formed in a closure of the high pressure vessel, a second thermocouple for measuring a temperature of the relief pipe system proximate the third opening and closing valve, a third thermocouple for measuring a temperature of the safety pipe system proximate the safety device, and a relief side interlocking means operable when any one of temperature signals from the first, second and third thermocouples exceeds a preset value for closing the second and fourth opening and closing valves, opening the third opening and closing valve, stopping operation of the gas compressor and disconnecting a power source for the furnace in the high pressure vessel.

Also with the interlocking device, possible damage to a pipe or the like of the HIP equipment can be prevented similary.

According to yet a further aspect of the present invention, there is provided an interlocking device for a hot isostatic pressurizing equipment which includes a gas cylinder, a gas compressor, a high pressure vessel, a furnace in the high pressure vessel, a processing gas pipe system for supplying processing gas from the gas cylinder to the high pressure vessel by way of the gas compressor, a relief pipe system connected to the processing gas pipe system between the gas compressor and the high pressure vessel for relieving a pressure to the atmospheric air, a safety pipe system connected to the processing gas pipe system between the gas compressor and the high pressure vessel and having a safety device for being burst, when the pressure within the high pressure vessel rises higher than a predetermined level, to relieve the pressure, and a first opening and closing valve interposed in the processing gas pipe system, the interlocking device comprising a processing gas sampling pipe connected to the processing gas pipe system between the gas cylinder and the gas compressor, an oxygen concentration sensor provided in the processing gas sampling pipe for detecting a concentration of oxygen in processing gas, a supply side interlocking means operable when the oxygen concentration sensor detects an oxygen concentration higher than a predetermined level for closing the first opening and closing valve in the processing gas pipe system and disconnecting a power source for the furnace in the high pressure vessel, a second opening and closing valve provided in the processing gas pipe system between the gas cylinder and the gas compressor, a third opening and closing valve interposed in the relief pipe system, a fourth opening and closing valve interposed in the safety pipe system, a flow switch provided in the safety pipe system for detecting processing gas being spouted from the safety pipe system when the pressure in the high pressure vessel lowers lower than the predetermined pressure after the safety device has been burst, a first thermocouple for measuring a temperature of the processing gas pipe system proximate a gas introducing port formed in a closure of the high pressure vessel, a second thermocouple for measuring a temperature of the relief pipe system proximate the third opening and closing valve, a third thermocouple for measuring a temperature of the safety pipe system proximate the safety device, and a relief side interlocking means operable when the flow switch detects processing gas being spouted from the safety pipe system and any one of temperature signals from the first, second and third thermocouples exceeds a preset value for closing the second and fourth opening and closing valves, opening the third opening and closing valve, stopping operation of the gas compressor and disconnecting a power source for the furnace in the high pressure vessel.

Also with the interlocking device, possible damage to a pipe or the like of the HIP equipment can be prevented similarly.

According to yet a further aspect of the present invention, there is provided an interlocking device for a hot isostatic pressurizing equipment which includes a first furnace for an oxygen atmosphere, a second furnace for an atmosphere other than an oxygen atmosphere, a high pressure vessel adapted to alternatively receive therein one of the first and second furnaces, a gas cylinder, a gas compressor, a processing gas pipe system for supplying processing gas from the gas cylinder to the high pressure vessel by way of the gas compressor, a relief pipe system connected to the processing gas pipe system between the gas compressor and the high pressure vessel for relieving a pressure to the atmospheric air, a safety pipe system connected to the processing gas pipe system between the gas compressor and the high pressure vessel and having a safety device for being burst, when the pressure within the high pressure vessel rises higher than a predetermined level, to relieve the pressure, and a first opening and closing valve interposed in the processing gas pipe system, the interlocking device comprising a processing gas sampling pipe connected to the processing gas pipe system between the gas cylinder and the gas compressor, an oxygen concentration sensor provided in the processing gas sampling pipe for detecting a concentration of oxygen in processing gas, a discriminating circuit for making a discrimination between the first and second furnaces, a supply side interlocking means operable when the oxygen concentration sensor detects an oxygen concentration higher than a predetermined level and the discriminating circuit discriminates the second furnace for closing the first opening and closing valve in the processing gas pipe system and disconnecting a power source for the second furnace in the high pressure vessel, a second opening and closing valve provided in the processing gas pipe system between the gas cylinder and the gas compressor, a third opening and closing valve interposed in the relief pipe system, a fourth opening and closing valve interposed in the safety pipe system, a flow switch provided in the safety pipe system for detecting processing gas being spouted from the safety pipe system when the pressure in the high pressure vessel lowers lower than the predetermined pressure after the safety device has been burst, and a relief side interlocking means operable when the flow switch detects processing gas being spouted from the safety pipe system for closing the second and fourth opening and closing valves, opening the third opening and closing valve, stopping operation of the gas compressor and disconnecting a power source for the furnace in the high pressure vessel.

Also with the interlocking device, possible damage to a pipe or the like of the HIP equipment can be prevented similarly.

According to yet a further aspect of the present invention, there is provided an interlocking device for a hot isostatic pressurizing equipment which includes a first furnace for an oxygen atmosphere, a second furnace for an atmosphere other than an oxygen atmosphere, a high pressure vessel adapted to alternatively receive therein one of the first and second furnaces, a gas cylinder, a gas compressor, a processing gas pipe system for supplying processing gas from the gas cylinder to the high pressure vessel by way of the gas compressor, a relief pipe system connected to the processing gas pipe system between the gas compressor and the high pressure vessel for relieving a pressure to the atmospheric air, a safety pipe system connected to the processing gas pipe system between the gas compressor and the high pressure vessel and having a safety device for being burst, when the pressure within the high pressure vessel rises higher than a predetermined level, to relieve the pressure, and a first opening and closing valve interposed in the processing gas pipe system, the interlocking device comprising a processing gas sampling pipe connected to the processing gas pipe system between the gas cylinder and the gas compressor, an oxygen concentration sensor provided in the processing gas sampling pipe for detecting a concentration of oxygen in processing gas, discriminating circuit for making a discrimination between the first and second furnaces, a supply side interlocking means operable when the oxygen concentration sensor detects an oxygen concentration higher than a predetermined level and the discriminating circuit discriminates the second furnace for closing the first opening and closing valve in the processing gas pipe system and disconnecting a power source for the second furnace in the high pressure vessel, a second opening and closing valve provided in the processing gas pipe system between the gas cylinder and the gas compressor, a third opening and closing valve interposed in the relief pipe system, a fourth opening and closing valve interposed in the safety pipe system, a first thermocouple for measuring a temperature of the processing gas pipe system proximate a gas introducing port formed in a closure of the high pressure vessel, a second thermocouple for measuring a temperature of the relief pipe system proximate the third opening and closing valve, a third thermocouple for measuring a temperature of the safety pipe system proximate the safety device, and a relief side interlocking means operable when any one of temperature signals from the first, second and third thermocouples exceeds a preset value for closing the second and fourth opening and closing valves, opening the third opening and closing valve, stopping operation of the gas compressor and disconnecting a power source for the furnace in the high pressure vessel.

Also with the interlocking device, possible damage to a pipe or the like of the HIP equipment can be prevented similarly.

According to yet a further aspect of the present invention, there is provided an interlocking device for a hot isostatic pressurizing equipment which includes a first furnace for an oxygen atmosphere, a second furnace for an atmosphere other than an oxygen atmosphere, a high pressure vessel adapted to alternatively receive therein one of the first and second furnaces, a gas cylinder, a gas compressor, a processing gas pipe system for supplying processing gas from the gas cylinder to the high pressure vessel by way of the gas compressor, a relief pipe system connected to the processing gas pipe system between the gas compressor and the high pressure vessel for relieving a pressure to the atmospheric air, a safety pipe system connected to the processing gas pipe system between the gas compressor and the high pressure vessel and having a safety device for being burst, when the pressure within the high pressure vessel rises higher than a predetermined level, to relieve the pressure, and a first opening and closing valve interposed in the processing gas pipe system, the interlocking device comprising a processing gas sampling pipe connected to the processing gas pipe system between the gas cylinder and the gas compressor, an oxygen concentration sensor provided in the processing gas sampling pipe for detecting a concentration of oxygen in processing gas, a discriminating circuit for making a discrimination between the first and second furnaces, a supply side interlocking means operable when the oxygen concentration sensor detects an oxygen concentration higher than a predetermined level and the discriminating circuit discriminates the second furnace for closing the first opening and closing valve in the processing gas pipe system and disconnecting a power source for the second furnace in the high pressure vessel, a second opening and closing valve provided in the processing gas pipe system between the gas cylinder and the gas compressor, a third opening and closing valve interposed in the relief pipe system, a fourth opening and closing valve interposed in the safety pipe system, a flow switch provided in the safety pipe system for detecting processing gas being spouted from the safety pipe system when the pressure in the high pressure vessel lowers lower than the predetermined pressure after the safety device has been burst, a first thermocouple for measuring a temperature of the processing gas pipe system proximate a gas introducing port formed in a closure of the high pressure vessel, a second thermocouple for measuring a temperature of the relief pipe system proximate the third opening and closing valve, a third thermocouple for measuring a temperature of the safety pipe system proximate the safety device, and a relief side interlocking means operable when the flow switch detects processing gas being spouted from the safety pipe system and any one of temperature signals from the first, second and third thermocouples exceeds a preset value for closing the second and fourth opening and closing valves, opening the third opening and closing valve, stopping operation of the gas compressor and disconnecting a power source for the furnace in the high pressure vessel.

Also with the interlocking device, possible damage to a pipe or the like of the HIP equipment can be prevented similarly.

The above and other objects, features and advantages of the present invention will become apparent from the following description and the appended claims, taken in conjunction with the accompanying drawings.

DETAILED DESCRIPTION OF THE PREFERRED EMBODIMENTS

Figure 1:
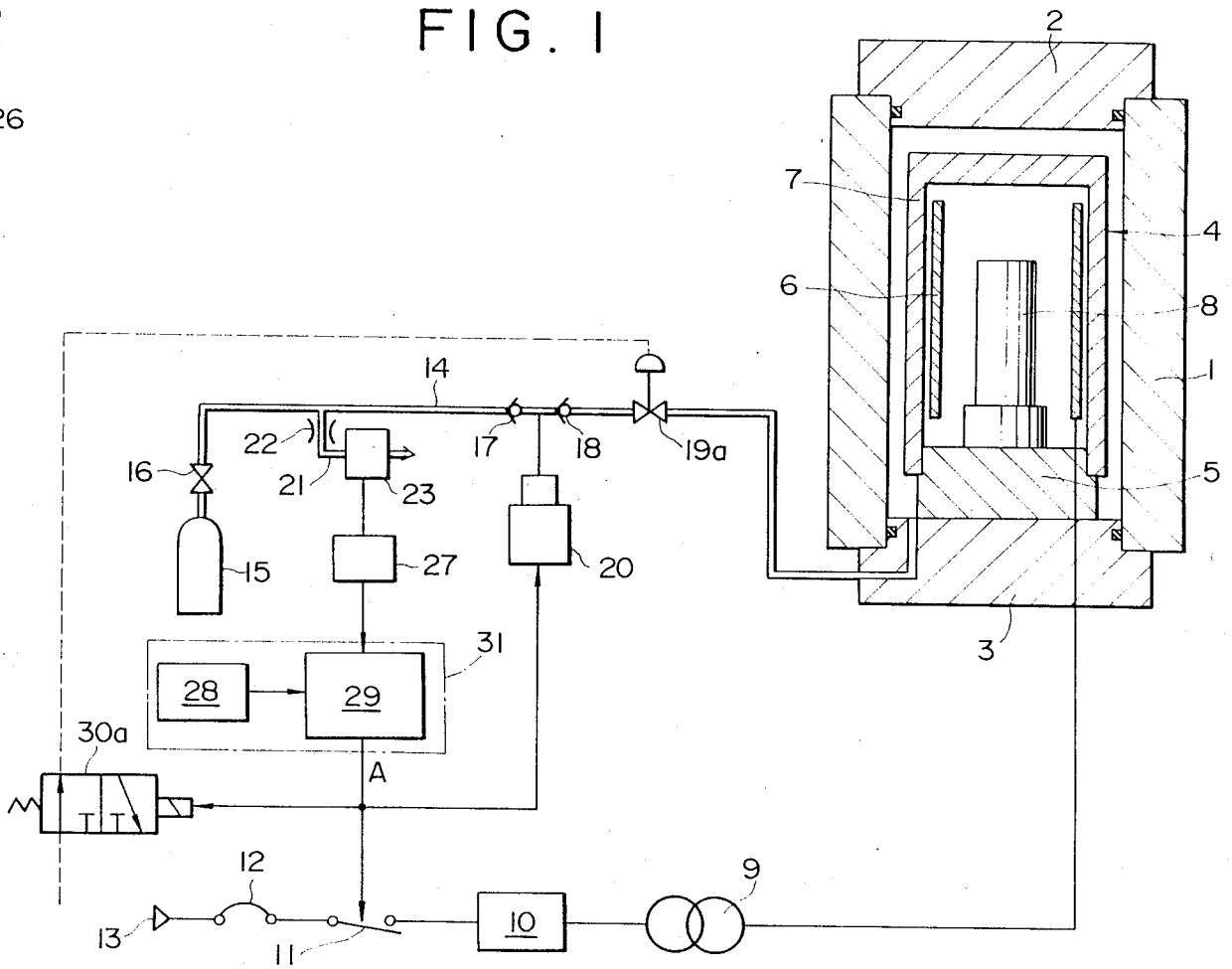
FIG. 1 is a diagrammatic representation of an interlocking device for a HIP equipment showing a first preferred embodiment of the present invention.

Referring first to FIG. 1, there is shown a HIP equipment in which an interlocking device according to a first preferred embodiment of the present invention is incorporated. The HIP equipment shown includes a high pressure vessel 1 having a top closure 2 and a bottom closure 3 thereon. A pressurizing axial force of the high pressure vessel 1 upon processing is supported by a press frame not shown. A furnace 4 is disposed in the high pressure vessel 1 and includes a heater 6, an insulation mantle 7 and so on disposed on a support table 5. A work 8 to be processed is placed on the support table 5. The heater 6 is connected to a power source 13 by way of a transformer 9, a thyristor circuit 10, an opening and closing switch 11, a breaker 12 and so forth.

A processing gas pipe system 14 is provided to supply and charge processing gas from a gas cylinder 15 into the high pressure vessel 1 by way of an opening and closing valve 16, a pair of check valves 17 and 18, another opening and closing valve 19*a* and so forth. A gas compressor 20 for compressing processing gas is connected to the pipe system 14 between the check valves 17 and 18. A processing gas sampling pipe 21 is connected to the lower pressure side of the pipe system 14 by way of a throttle valve 22, and thus sampled processing gas is discharged into the atmospheric air from the processing gas sampling pipe 21.

Figure 2:
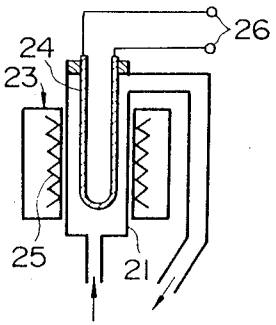
FIG. 2 is a schematic illustration showing an oxygen concentration sensor which is employed in the interlocking device of FIG. 1 and includes zirconia therein.

An oxygen concentration sensor 23 is provided in the inside of the pipe 21 for electrically detecting a concentration of oxygen in processing gas. The oxygen concentration sensor 23 may be any of the zirconia type, the magnetic type, the electrode type and so forth. In the case of, for example, a zirconia sensor, a zirconia cell 24 may be disposed in the inside of the pipe 21 as shown in FIG. 2. Referring to FIG. 2, if the zirconia cell 24 is heated red-hot by a cell heater 25 and exposed to processing gas, then movement of oxygen ions is caused in the zirconia cell 24 because the partial pressures of oxygen on the opposite interfaces of the zirconia cell 24. Consequently, an electromotive force is produced between a pair of electrodes 26 in accordance with a concentration of oxygen in the processing gas. Accordingly, such oxygen concentration can be measured depending upon a magnitude of the electromotive force.

Referring back to FIG. 1, an amplifier 27 for amplifying a detection signal of the sensor 23 and a setting device 28 for setting a limit value to the concentration of oxygen in processing gas are also provided. An arithmetic unit 29 is provided to compare a detection value from the sensor 23 and a set value from the setting device 28. When the detection value is higher than the set value, that is, when the oxygen concentration is higher than a predetermined level, the arithmetic unit 29 develops an interlocking signal A. In response to such interlocking signal A, an air pipe solenoid valve 30*a* is energized to close the opening and closing valve 19*a* while the opening and closing switch 11 is turned off and the gas compressor 20 is stopped. It is to be noted that an interlocking means 31 is constituted from the setting device 28 and the arithmetic unit 29.

When processing gas is to be charged into the high pressure vessel 1, it is supplied from the gas cylinder 15 into the high pressure vessel 1 by way of the pipe system 14. In this instance, part of the processing gas is sampled by means of the pipe 21, and a concentration of oxygen in the thus sampled processing gas is detected by the sensor 23. After such sampling, the processing gas is discharged into the atmospheric air.

If a detection value detected by the sensor 23 is higher than a set value by the setting device 28, the arithmetic unit 29 comparing the two values develops an interlocking signal A. Thus, in response to such interlocking signal A, the opening and closing valve 19*a* is closed while the opening and closing switch 11 is turned off and the gas compressor 20 is stopped. Accordingly, charging of processing gas into the high pressure vessel 1 is stopped and energization of the heater 6 is stopped. Consequently, possible damage to the HIP equipment which may caused by oxygen of an excessively high concentration can be prevented.

Figure 3:
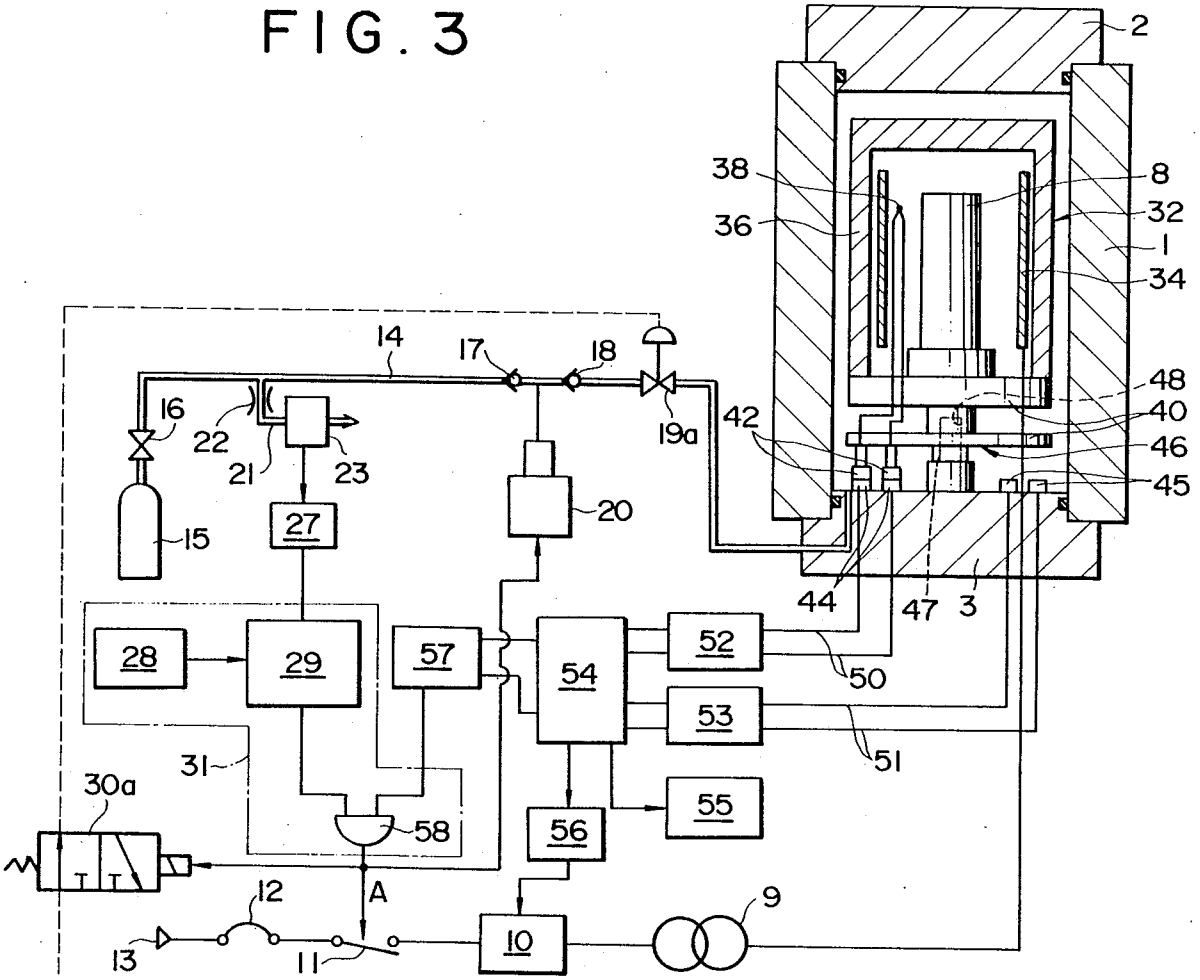
FIG. 3 is diagrammatic representation of an interlocking device for a HIP equipment showing a second preferred embodiment of the present invention wherein a HIP process is performed in an inert gas atmosphere.

Referring now to FIG. 3, there is shown an interlocking device for a HIP equipment according to a second preferred embodiment of the present invention. In this instance, the HIP equipment is constructed such that a furnace for an oxygen atmosphere and another furnace for any atmosphere other than an oxygen atmosphere may be alternatively mounted and used in a single high pressure vessel, and the interlocking device has an additional function to discriminate a type of a furnace being used and additionally employs such discrimination of requirements for interlocking.

Figure 4:
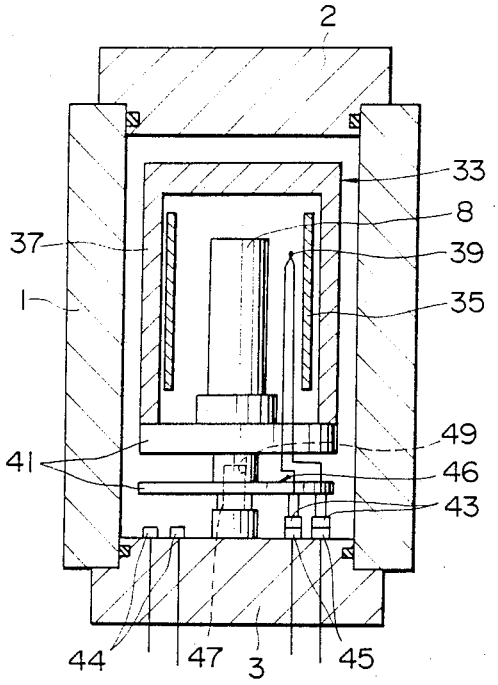
FIG. 4 is a schematic sectional view of the HIP equipment shown in FIG. 3 wherein a HIP process is performed in an oxygen atmosphere.

In particular, a graphite furnace 32 for performing a high temperature processing in an inert gas atmosphere therein is shown mounted in a high pressure vessel 1 in FIG. 3 while a platinum-rhodium alloy furnace 33 for performing a processing in an oxygen atmosphere therein is shown mounted in the high pressure vessel 1 in FIG. 4.

Each of the furnaces 32 and 33 includes a heater 34 or 35, an insulation mantle 36 or 37, a thermocouple 38 or 39 and so forth and is placed on a support table 40 or 41, respectively. A W-Re thermocouple may be employed as the thermocouple 38 of the graphite furnace 32 while a platinum-rhodium thermocouple may be employed as the thermocouple 39 of the platinum-rhodium furnace 33 so that they may be suited for the individual processing conditions.

A pair of thermocouple terminals 42 or 43 are provided at difference positions on the support table 40 or 41 for each of the furnaces 32 and 33 and connected to the opposite ends of each of the thermocouples 38 or 39, respectively. Another pair of thermocouple terminals 44 or 45 are mounted on a bottom closure 3 in a corresponding relationship to the thermocouple 42 or 43, respectively.

Figure 5:
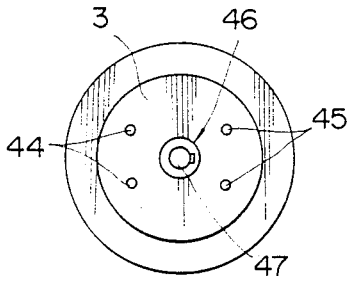
FIG. 5 is a sectional view of a bottom closure of the HIP equipment shown in FIG. 3.

A positioning mechanism 46 is provided in the high pressure vessel 1 and includes, as shown in FIG. 5, a support post 47 provided projectingly at the center of the bottom closure 3 and having a key thereon, and a recess 48 or 49 formed in each of the support tables 40 and 41 and having a keyway formed therein, respectively. Thus, when the furnace 32 or 33 is mounted in position onto the bottom closure 3, it may be positioned such that the corresponding terminals, that is, the terminals 42 and 44 or the terminals 43 and 45, may be connected to each other as seen in FIG. 3 or 4, respectively.

Figure 6:
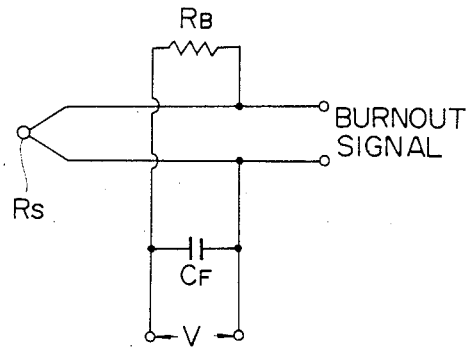
FIG. 6 is a circuit diagram of a burnout detecting section of a thermoelectric transducer employed in the interlocking device shown in FIG. 3.

Each of the thermocouple terminals 44 and 45 is connected to a temperature controller 54 by way of a pair of compensating lines 50 or 51 and a thermoelectric transducer 52 or 53, respectively. The temperature controller 54 compares a measured temperature from the thermocouple 38 or 39 with a set temperature from a function generator 55 to control a thyristor circuit 10 by way of a thyristor controlling circuit 56 to control the furnace 32 or 33 so that the process chamber temperature may be equal to the set temperature. The temperature controller 54 is constructed so that it may develop a burnout signal which represents a discrimination of the furnace 32 or 33. In particular, when the thermocouple 38 or 39 is connected as shown in FIG. 6, only very low current will flow through a resistor $R_S$ and a capacitor $C_F$ will be charged little because the resistance of another resistor $R_B$ is very high compared to the resistor $R_S$. To the contrary, if none of the thermocouples 38 and 39 is connected, then the resistor $R_S$ now presents an infinitely high resistance. Consequently, the capacitor $C_F$ is charged, and a burnout signal is developed.

A discriminating circuit 57 is provided for discriminating the furnace 32 or 33. When the thermocouple terminals 45 are non-conducting while the other thermocouple terminals 44 are conducting, the discriminating circuit 57 discriminates the furnace 32 in response to a burnout signal from the temperature controller 54 and develops a discrimination signal of the same. An AND circuit 58 develops an interlocking signal A when it receives a signal from an arithmetic unit 29 and a discrimination signal from the discriminating circuit 57, that is, when the concentration of oxygen in processing gas is higher than a predetermined level and the furnace 32 is set in position in the high pressure vessel 1.

When the graphite furnace 32 is to be selectively used, a top closure 2 of the high pressure vessel 1 is removed, and the furnace 32 is inserted from above into the high pressure vessel 1 and set in position onto the bottom closure 3 by means of the positioning mechanism 46. Consequently, the terminals of the support table 40 are connected to the terminals 44 of the bottom closure 3 while the terminals 45 remain in a non-conducting state. Consequently, the discriminating circuit 57 operates in response to a burnout signal from the temperature controller 54 to thus discriminate mounting of the furnace 32 and develop a discrimination signal of the same.

After the mounting of the furnace 32, processing gas is supplied and charged into the high pressure vessel 1 from the gas cylinder 15. Thereupon, if the concentration of oxygen in the processing gas exceeds an allowable limit value, the AND circuit 58 is opened in response to a signal from the arithmetic unit 29 and the identification signal from the discriminating circuit 57 and develops an interlocking signal A. Consequently, the opening and closing valve 19*a* is closed while the opening and closing switch 11 is turned off and the gas compressor 20 is stopped. Accordingly, if the graphite furnace 32 is set in error for a HIP process in an oxygen atmosphere, or else if oxygen mixture gas is supplied as processing gas into the high pressure vessel 1 in a HIP process in an inert gas atmosphere, possible wear of the graphite furnace 32 by oxidation can be prevented.

Figure 7:
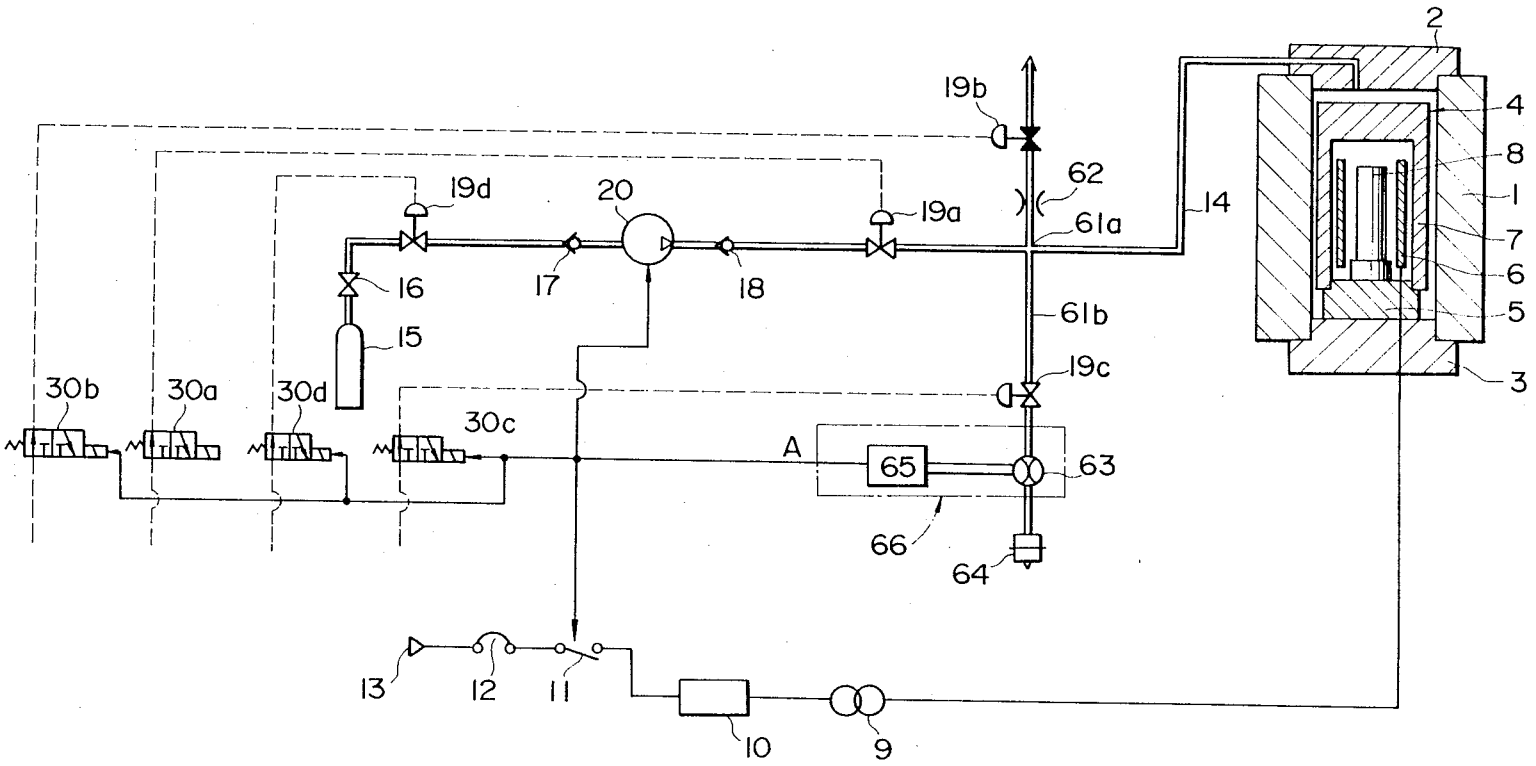
FIG. 7 is a diagrammatic representation of an interlocking device for a HIP equipment showing a third preferred embodiment of the present invention.

Referring now to FIG. 7, there is shown an interlocking device for a HIP equipment according to a third preferred embodiment of the present invention. A high pressure vessel 1 of the HIP equipment has a top closure 2 and a bottom closure 3 thereon, and a pressurizing axial force of the high pressure vessel 1 upon processing is received by a press frame not shown. A furnace 4 includes a heater 6, an insulation mantle 7 and so forth disposed on a support table 5. A work 8 to be processed is placed on the support table 5. The heater 6 is connected to a power source 13 by way of a transformer 9, a thyristor circuit 10, an opening and closing switch 11, a breaker 12 and so forth.

A processing gas pipe system 14 is provided to supply and charge processing gas from a gas cylinder 15 into the high pressure vessel 1 by way of a pair of opening and closing valves 16 and 19*d*, a pair of check valves 17 and 18, another opening and closing valve 19*a* and so forth. A gas compressor 20 for compressing processing gas is interposed in the pipe system 14.

A relief pipe system 61*a* for relieving pressure gas into the atmospheric air and a safety pipe system 61*b* for discharging processing gas into the atmospheric air when the pressure within the high pressure vessel 1 is increased higher than a designed pressure are connected to the processing gas system 14 between the gas compressor 20 and the high pressure vessel 1. A throttle valve 62 is connected to the processing gas pipe system 14 by way of the relief pipe system 61*a*, and an opening and closing valve 19*b* is connected to a portion of the processing gas pipe system 14 ahead of the throttle valve 62 so that the pressure may be maintained by opening or closing the opening and closing valve 19*b*.

A flow switch 63 is interposed in the pipe system 61*b*, and a rupture disk 64 is mounted on the pipe system 61*b* ahead of the flow switch 63 while an opening and closing valve 19*c* is mounted on an upper side of the flow switch 63. The rupture disk 64 serves as a safety device which is burst to relieve the pressure within the pipe system 61*b* if the pressure is increased higher than a predetermined level. The flow switch 63 detects processing gas flowing in the pipe system 61*b* when the pressure is decreased lower than a designed pressure after the rupture disk 64 has been burst. If the flow switch 63 detects a flow of processing gas and develops a detection signal, such signal is amplified by an amplifier 65 and makes an interlocking signal A. A solenoid valve 30*b* is thus energized in response to the interlocking signal A to open the opening and closing signal 19*b* while further solenoid valves 30*c* and 30*d* are energized to close the opening and closing valves 19*c* and 19*d*. Simultaneously, the power source 13 for the furnace 4 is disconnected by the opening and closing switch 11, and the gas compressor 20 is stopped. It is to be noted that an interlocking means 66 is constituted from the flow switch 63 and the amplifier 65.

Now, if the pressure of the high pressure vessel 1 is increased higher than the designed pressure so that the rupture disk 64 is burst, processing gas will flow through the pipe system 61*b*, and the flow switch 63 will detect such flow of the processing gas and develop a detection signal. The detection signal is amplified by the amplifier 65 and makes an interlocking signal A. In response to such interlocking signal A, the solenoid valve 30*b* is energized to open the opening and closing valve 19*b*, and the solenoid valves 30*c* and 30*d* are energized to close the opening and closing valves 19*c* and 19*d*, respectively, while the opening and closing switch 11 is turned off and the gas compressor 20 is stopped. Accordingly, spouting of a large amount of high temperature gas from the pipe system 61*b* is stopped and the excessively high pressure is relieved gradually by way of the throttle valve 62 from the pipe system 61*a*. Meanwhile, supply of gas into the high pressure vessel 1 is stopped, and the heater 6 is deenergized. Consequently, possible damage to the pipes of the HIP equipment which may be caused by leakage of a large amount of high temperature oxygen containing gas can be prevented.

Figure 8:
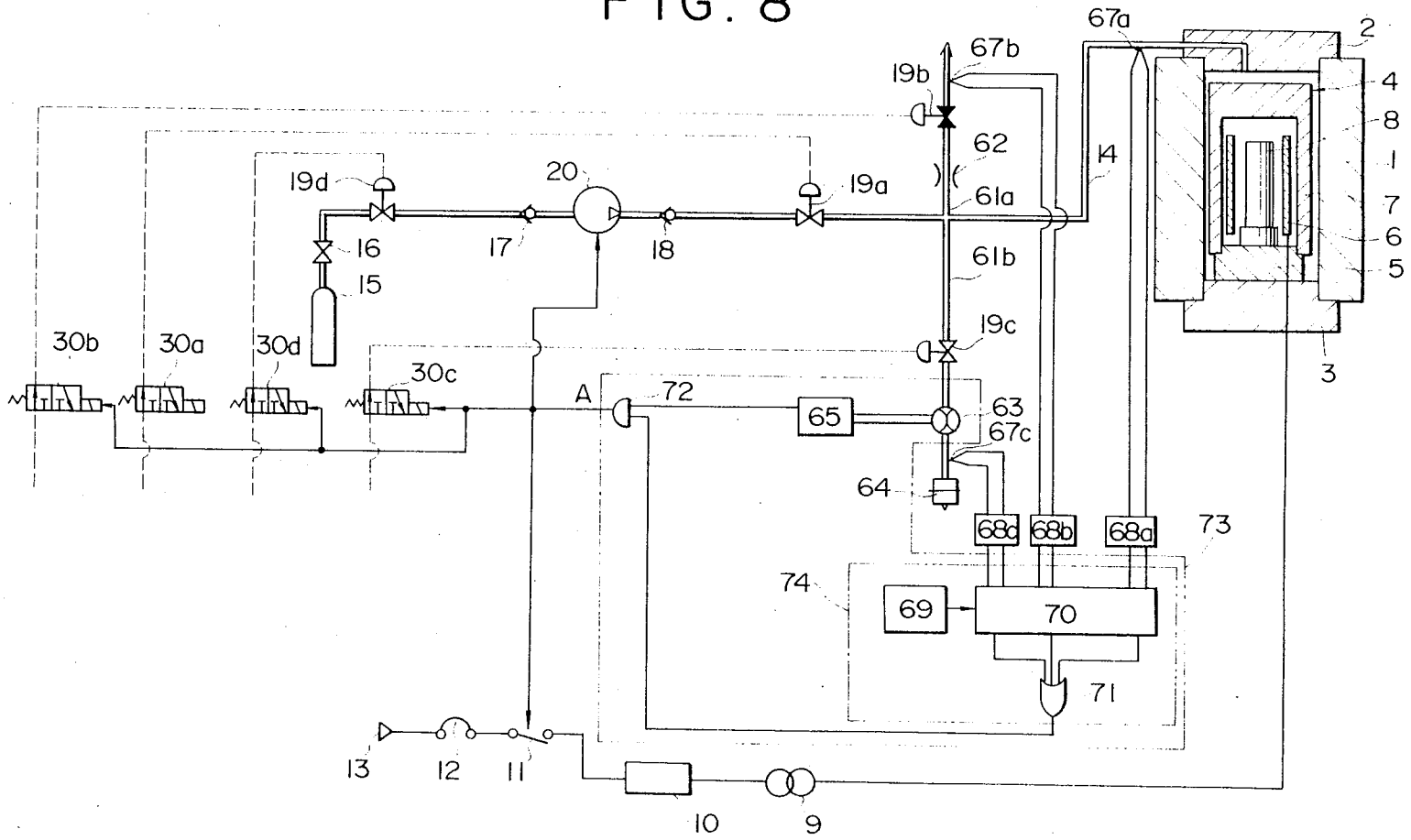
FIG. 8 is a similar view but showing an interlocking device for a HIP equipment according to a fourth preferred embodiment of the present invention.

Referring now to FIG. 8, there is shown an interlocking device for a HIP equipment according to a fourth preferred embodiment of the present invention. The interlocking device is a modification of the interlocking device shown in FIG. 7 in that a thermocouple 67*a* for measuring a temperature is mounted on a pipe 14 proximate a gas introducing port formed in a top closure 2 and another thermocouple 67*b* for measuring a temperature is mounted on a pipe system 61*a* proximate an opening and closing valve 19*b* while a further thermocouple 67*c* for measuring a temperature is mounted on a pipe system 61*b* proximate a rupture disk 64. The thermocouples 67*a*, 67*b* and 67*c* are connected to thermoelectric transducers 68*a*, 68*b* and 68*c*, respectively. A setting device 69 is provided for setting an allowable limit to the temperature for each pipe system. An arithmetic unit 70 compares pipe temperatures from the thermocouples 67*a*, 67*b* and 67*c* with a set temperature from the setting device 69 and develops a detection signal when any of the pipe temperatures is higher than the set temperature. An OR circuit 71 delivers a signal to an AND circuit 72 when a detection signal is received from the arithmetic unit 70. The AND circuit 72 develops an interlocking signal A when it receives both of such detection signal from the arithmetic unit 70 and a detection signal from a flow switch 63, that is, when the rupture disk 64 is burst to allow processing gas to be spouted therefrom and then the temperature of any pipe system is raised beyond the set temperature. It is to be noted that, in this arrangement, an interlocking means 73 is constituted from the flow switch 63, amplifier 65, setting device 69, arithmetic unit 70, OR circuit 71 and AND circuit 72.

If an interlocking signal A is developed, then a solenoid valve 30*b* is energized to open the opening and closing valve 19*b* but solenoid valves 30*c* and 30*d* are energized to close opening and closing valves 19*c* and 19*d*, respectively, while an opening and closing switch 11 is disconnected and a gas compressor 20 is stopped. Consequently, spouting of a large amount of high temperature gas from the pipe system 61*b* is stopped and the excessively high pressure is gradually relieved by way of a throttle valve 62 from the pipe system 61*a*. Since the temperature of any pipe system will not be increased higher than the set temperature and supply of gas into the high pressure vessel 1 is stopped while the heater 6 is deenergized, possible damage to the pipe systems of the HIP equipment which may be caused by leakage of a large amount of high temperature oxygen containing gas can be prevented. Accordingly, a safety device having a very high degree of reliability can be attained.

It is to be noted that an interlocking means 74 may be constituted from the setting device 69, arithmetic unit 70 and OR circuit 72 so that an interlocking signal A may be provided as an output signal of the OR circuit 71 in FIG. 8.

Further, the safety device may be any other safety device than such rupture disk 64 as described above.

Figure 9:
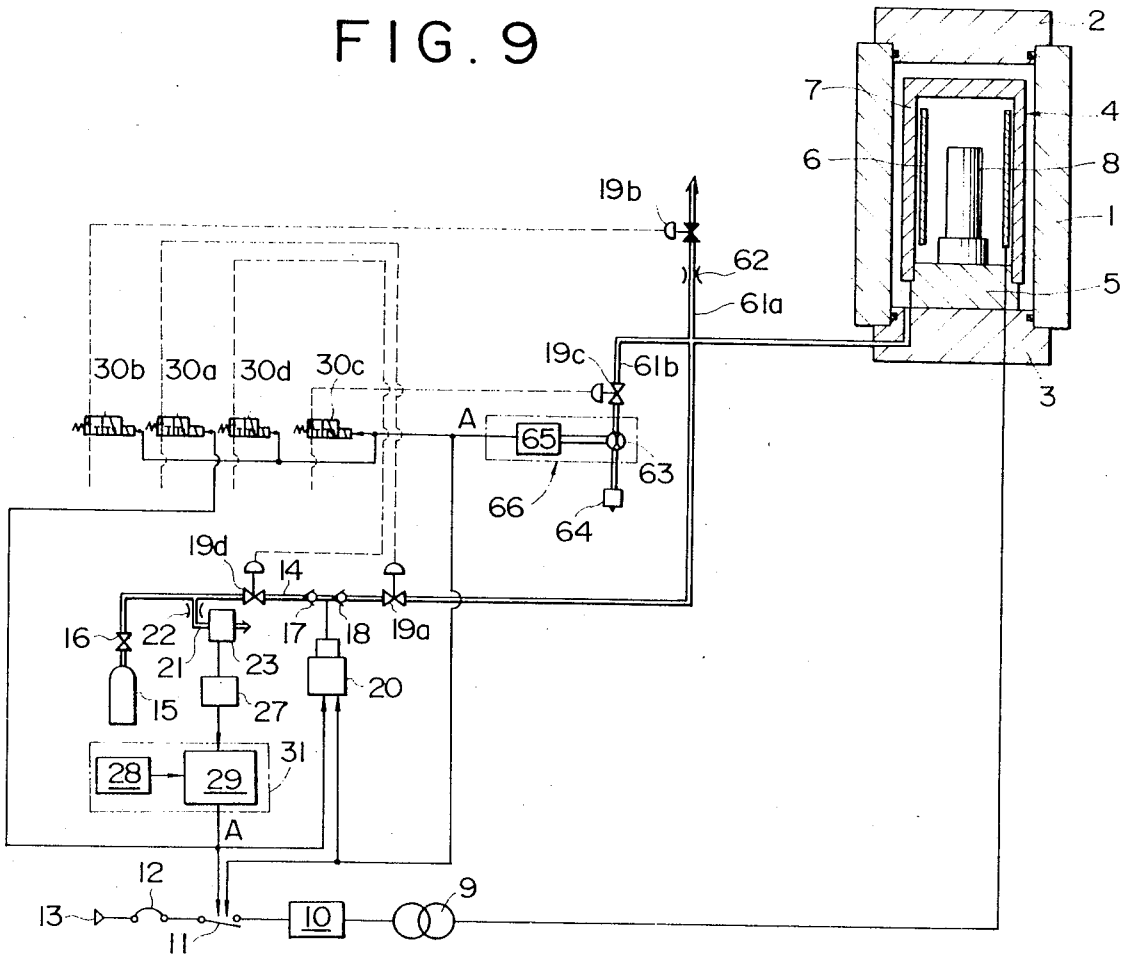
FIG. 9 is a diagrammatic representation of an interlocking device for a HIP equipment showing a fifth preferred embodiment of the present invention.

FIG. 9 shows an interlocking device for a HIP equipment according to a fifth preferred embodiment of the present invention. The interlocking device shown is formed as a suitable combination of the interlocking device shown in FIG. 1 and the interlocking device shown in FIG. 7, and accordingly, detailed description thereof is omitted herein to avoid redundancy. It is to be noted, however, that the interlocking means 31 of FIG. 1 serves as a supply side interlocking means operable when the oxygen concentration sensor 23 detects an oxygen concentration higher than a predetermined level for closing the opening and closing valve 19*a* in the processing gas pipe system 14 and disconnecting the power source 13 for the furnace 4 in the high pressure vessel 1 while the interlocking means 63 of FIG. 7 serves as a relief side interlocking means operable when the flow switch 63 detects processing gas being spouted from the safety pipe system 61*b* for closing the opening and closing valves 19*d* and 19*c*, opening the opening and closing valve 19*b*, stopping operation of the gas compressor 20 and disconnecting the power source 13 for the furnace 4 in the high pressure vessel 1.

Figure 10:
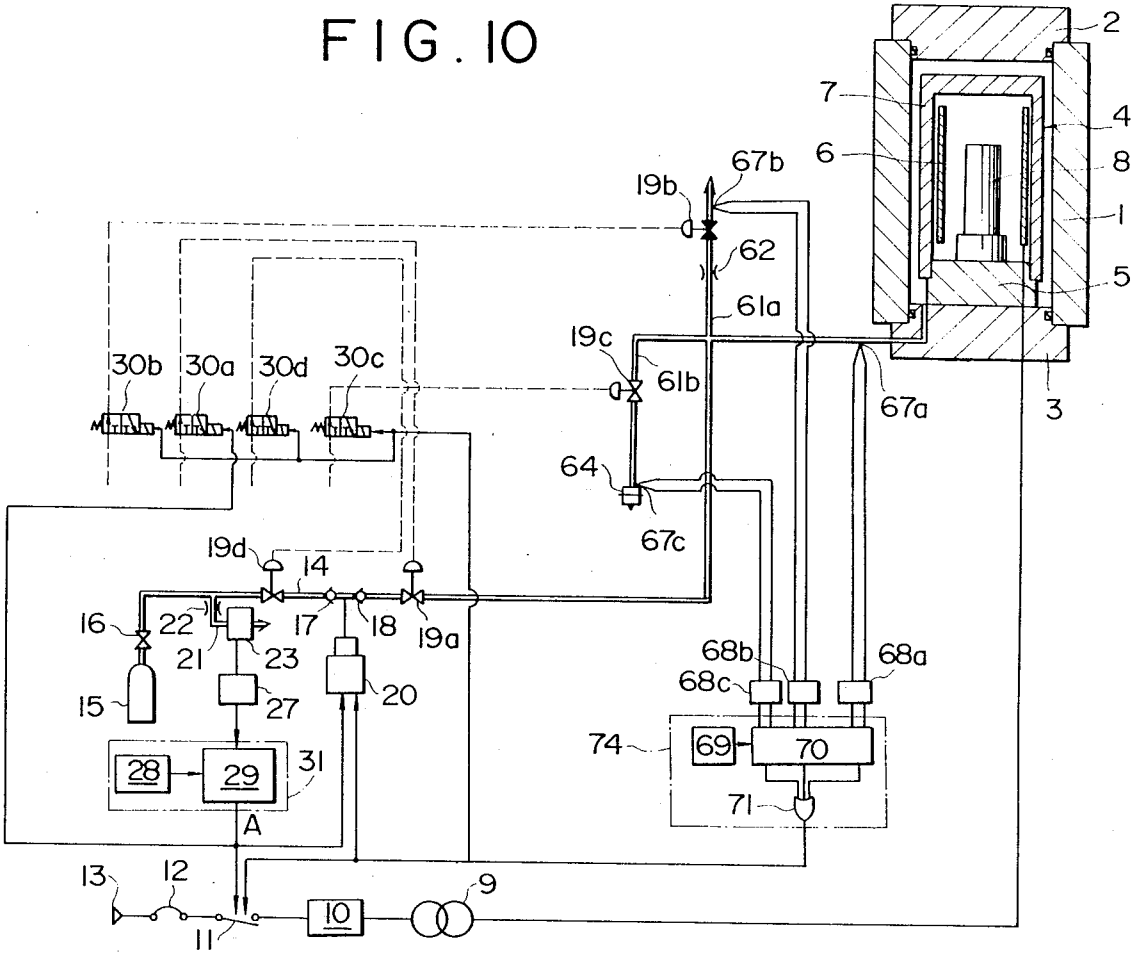
FIG. 10 is a similar view but showing an interlocking device for a HIP equipment according to a sixth preferred embodiment of the present invention.

FIG. 10 shows an interlocking device for a HIP equipment according to a sixth preferred embodiment of the present invention. The interlocking device shown is formed as a suitable combination of the interlocking device shown in FIG. 1 and the interlocking device shown in FIG. 8. In the interlocking device of the present embodiment, the interlocking means 31 of FIG. 1 serves as a supply side interlocking means while the interlocking means 74 of FIG. 8 serves as a relief side interlocking means.

Figure 11:
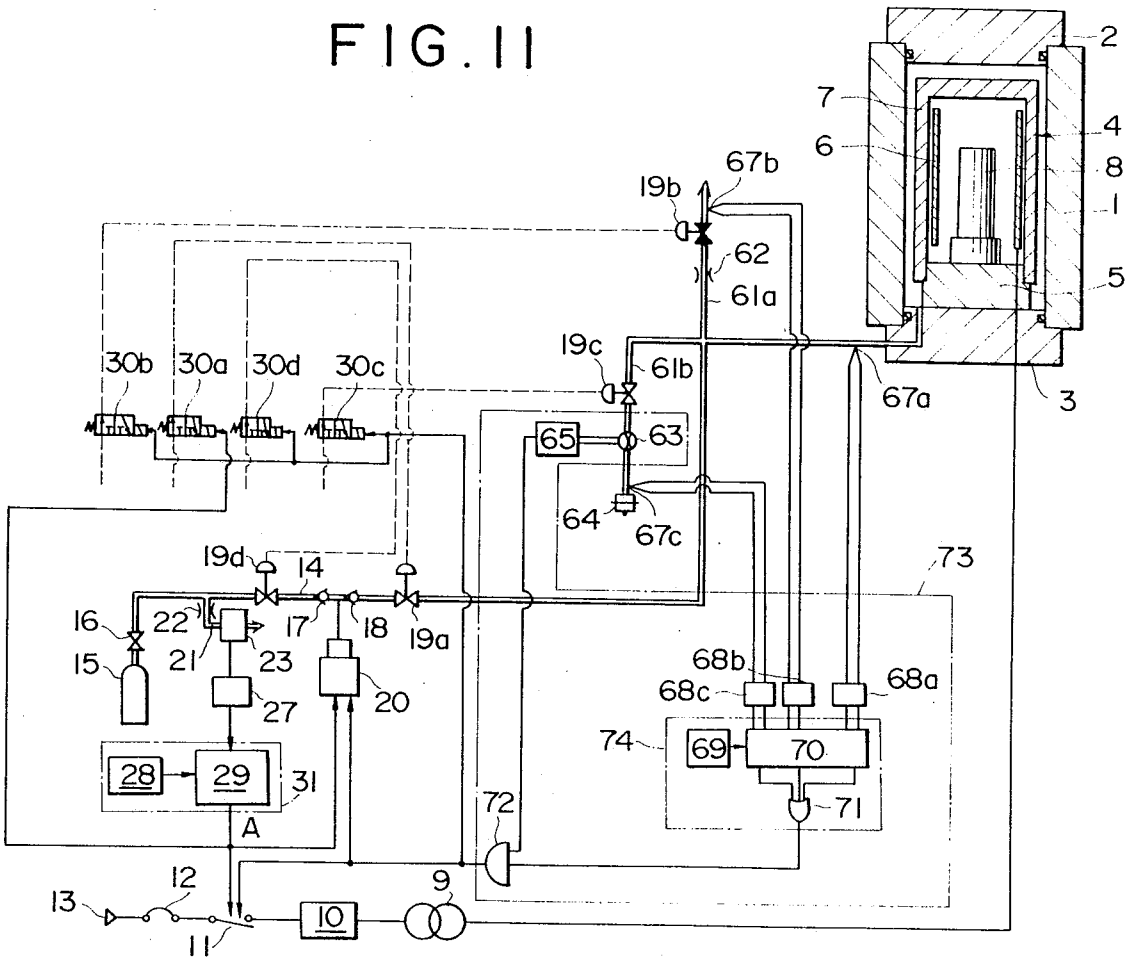
FIG. 11 is a similar view but showing an interlocking device for a HIP equipment according to a seventh preferred embodiment of the present invention.

FIG. 11 shows an interlocking device for a HIP equipment according to a seventh embodiment of the present invention. The interlocking device shown is formed as a suitable combination of the interlocking device shown in FIG. 1 and the interlocking device shown in FIG. 8. In the interlocking device of the present embodiment, however, the interlocking means 31 of FIG. 1 serves as a supply side interlocking means while the interlocking means 73 of FIG. 8 serves as a relief side interlocking means.

Figure 12:
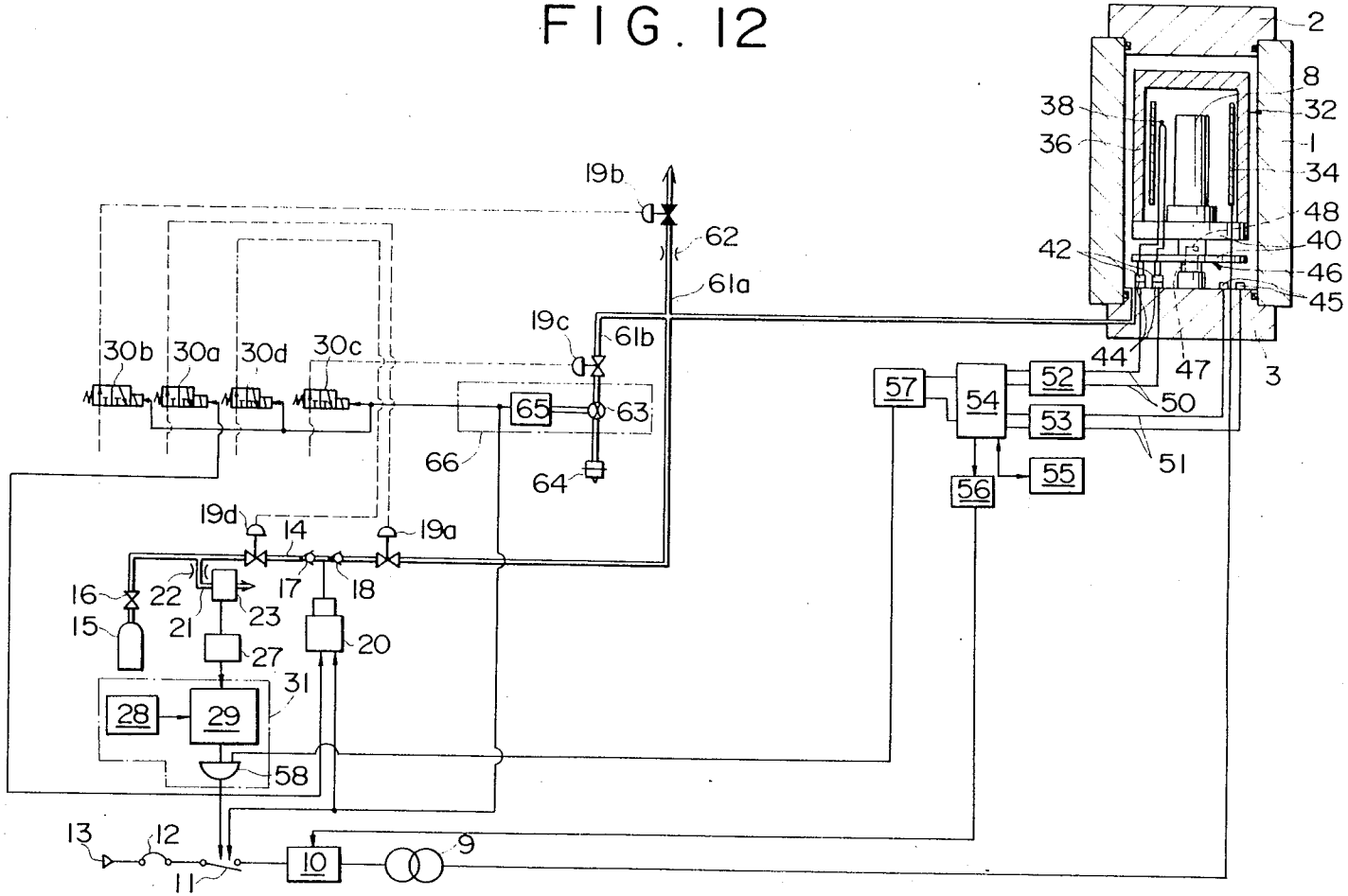
FIG. 12 is a similar view but showing an interlocking device for a HIP equipment according to an eighth preferred embodiment of the present invention.

FIG. 12 shows an interlocking device for a HIP equipment according to an eighth preferred embodiment of the present invention. The interlocking device shown is formed as a suitable combination of the interlocking device shown in FIG. 3 and the interlocking device shown in FIG. 7. In the interlocking device of the present embodiment, the interlocking means 31 of FIG. 3 serves as a supply side interlocking means while the interlocking means 63 of FIG. 7 serves as a relief side interlocking means.

Figure 13:
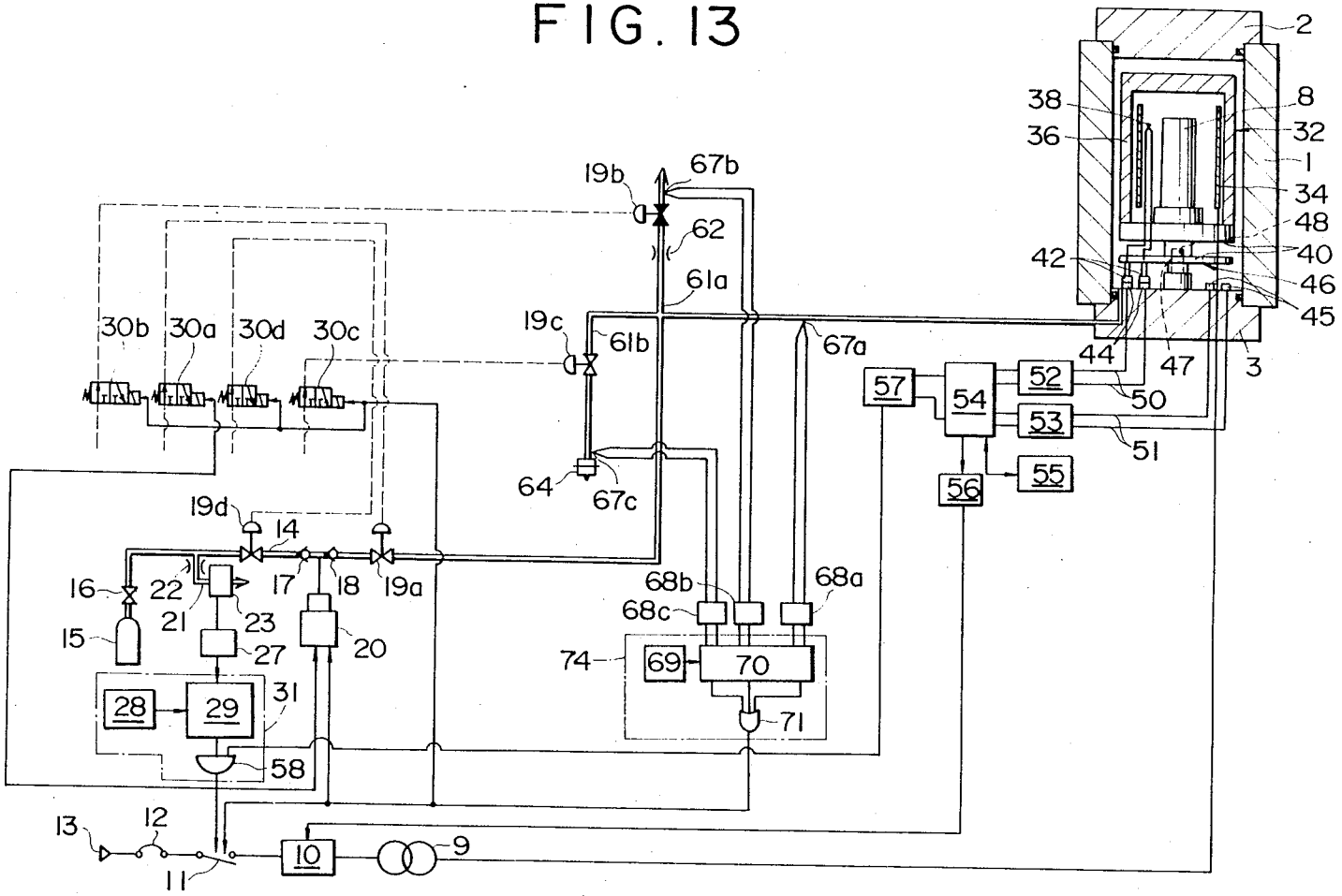
FIG. 13 is a similar view but showing an interlocking device for a HIP equipment according to a ninth preferred embodiment of the present invention.

FIG. 13 shows an interlocking device for a HIP equipment according to a ninth preferred embodiment of the present invention. The interlocking device shown is formed as a suitable combination of the interlocking device shown in FIG. 3 and the interlocking device shown in FIG. 8. In the interlocking device of the present embodiment, the interlocking means 31 of FIG. 3 serves as a supply side interlocking means while the interlocking means 74 of FIG. 8 serves as a relief side interlocking means.

Figure 14:
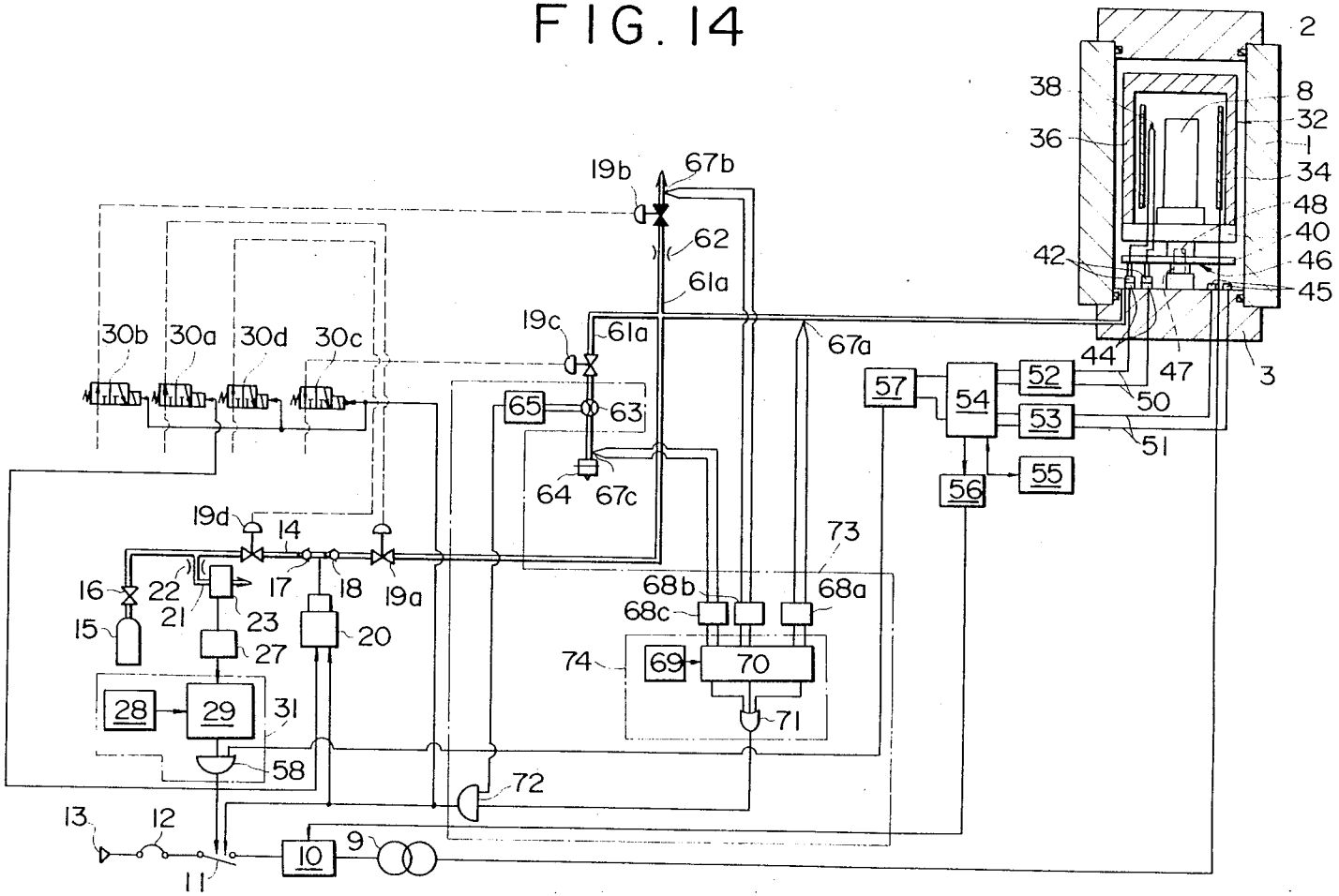
FIG. 14 is a similar view but showing an interlocking device for a HIP equipment according to a tenth preferred embodiment of the present invention.

FIG. 14 shows an interlocking device for a HIP equipment according to a tenth preferred embodiment of the present invention. The interlocking device shown is formed as a suitable combination of the interlocking device shown in FIG. 3 and the interlocking device shown in FIG. 8. In the interlocking device of the present embodiment, the interlocking means 31 of FIG. 3 serves as a supply side interlocking means while the interlocking means 73 of FIG. 8 serves as a relief side interlocking means.

Having now fully described the invention, it will be apparent to one of ordinary skill in the art that many changes and modificaitons can be made thereto without departing from the spirit and scope of the invention as set forth herein.

What is claimed is:

1. An interlocking device for a hot isostatic pressurizing equipment which includes a high pressure vessel, a furnace in said high pressure vessel, a processing gas pipe system for supplying processing gas into said high pressure vessel, and an opening and closing valve interposed in said processing gas pipe system, comprising a processing gas sampling pipe connected to said processing gas pipe system, an oxygen concentration sensor provided in said processing gas sampling pipe for detecting a concentration of oxygen in said processing gas, and an interlocking means operable when said oxygen concentration sensor detects an oxygen concentration higher than a predetermined level for closing said opening and closing valve in said processing gas pipe system and disconnecting a power source for said furnace in said high pressure vessel.

2. An interlocking device for a hot isostatic pressurizing equipment according to claim 1, wherein said processing gas sampling pipe is connected to said processing gas pipe system between a gas cylinder and a gas compressor.

3. An interlocking device for a hot isostatic pressurizing equipment which includes a first furnace for an oxygen atmosphere, a second furnace for an atmosphere other than an oxygen atmosphere, a high pressure vessel adapted to alternatively receive therein one of said first and second furnaces, a processing gas pipe system for supplying processing gas into said high pressure vessel, and an opening and closing valve interposed in said processing gas pipe system. comprising a processing gas sampling pipe connected to said processing gas pipe system, an oxygen concentration sensor provided in said processing gas sampling pipe for detecting a concentration of oxygen in said processing gas, a discriminating circuit for distinguishing between said first and second furnaces, and an interlocking means operable when said oxygen concentration sensor detects an oxygen concentration higher than a predetermined level and said discriminating circuit identifies said second furnace for closing said opening and closing valve in said processing gas pipe system and disconnecting a power source for said second furnace in said high pressure vessel.

4. An interlocking device for a hot isostatic pressurizing equipment according to claim 3, wherein said processing gas sampling pipe is connected to said processing gas pipe system between a gas cylinder and a gas compressor.

5. An interlocking device for a hot isostatic pressurizing equipment which includes a gas cylinder, a gas compressor, a high pressure vessel, a furnace in said high pressure vessel, a processing gas pipe system for supplying processing gas from said gas cylinder to said high pressure vessel by way of said gas compressor, a relief pipe system connected to said processing gas pipe system between said gas compressor and said high pressure vessel for relieving a pressure to the atmospheric air, a safety pipe system connected to said processing gas pipe system between said gas compressor and said high pressure vessel and having a safety device for being burst, when the pressure within said high pressure vessel rises higher than a predetermined level, to relieve the pressure, comprising a first opening and closing valve provided in said processing gas pipe system between said gas cylinder and said gas compressor, a second opening and closing valve interposed in said relief pipe system, a third opening and closing valve interposed in said safety pipe system, a flow switch provided in said safety pipe system for detecting processing gas being spouted from said safety pipe system when the pressure in said high pressure vessel falls lower than the predetermined pressure after said safety device has been burst, and an interlocking means operable when said flow switch detects processing gas being spouted from said safety pipe system for closing said first and third opening and closing valves, opening said second opening and closing valve, stopping operation of said gas compressor and disconnecting a power source for said furnace in said high pressure vessel.

6. An interlocking device for a hot isostatic pressurizing equipment which includes a gas cylinder, a gas compressor, a high pressure vessel, a furnace in said high pressure vessel, a processing gas pipe system for supplying processing gas from said gas cylinder to said high pressure vessel by way of said gas compressor, a relief pipe system connected to said processing gas pipe system between said gas compressor and said high pressure vessel for relieving a pressure to the atmospheric air, a safety pipe system connected to said processing gas pipe system between said gas compressor and said high pressure vessel and having a safety device for being burst, when the pressure within said high pressure vessel rises higher than a predetermined level, to relieve the pressure, comprising a first opening and closing valve provided in said processing gas pipe system between said gas cylinder and said gas compressor, a second opening and closing valve interposed in said relief pipe system, a third opening and closing valve interposed in said safety pipe system, a first thermocouple for measuring a temperature of said processing gas pipe system proximate a gas introducing port formed in a closure of said high pressure vessel, a second thermocouple for measuring a temperature of said relief pipe system proximate said second opening and closing valve, a third thermocouple for measuring a temperature of said safety pipe system proximate said safety device, and an interlocking means operable when any one of the temperature signals from said first, second and third thermocouples exceeds a preset value for closing said first and third opening and closing valves, opening said second opening and closing valve, stopping operation of said gas compressor and disconnecting a power source for said furnace in said high pressure vessel.

7. An interlocking device for a hot isostatic pressurizing equipment which includes a gas cylinder, a gas compressor, a high pressure vessel, a furnace in said high pressure vessel, a processing gas pipe system for supplying processing gas from said gas cylinder to said high pressure vessel by way of said gas compressor, a relief pipe system connected to said processing gas pipe system between said gas compressor and said high pressure vessel for relieving a pressure to the atmospheric air, a safety pipe system connected to said processing gas pipe system between said gas compressor and said high pressure vessel and having a safety device for being burst, when the pressure within said high pressure vessel rises higher than a predetermined level, to relieve the pressure, comprising a first opening and closing valve provided in said processing gas pipe system between said gas cylinder and said gas compressor, a second opening and closing valve interposed in said relief pipe system, a third opening and closing valve interposed in said safety pipe system, a flow switch provided in said safety pipe system for detecting processing gas being spouted from said safety pipe system when the pressure in said high pressure vessel falls lower than the predetermined pressure after said safety device has been burst, a first thermocouple for measuring a temperature of said processing gas pipe system proximate a gas introducing port formed in a closure of said high pressure vessel, a second thermocouple for measuring a temperature of said relief pipe system proximate said second opening and closing valve, a third thermocouple for measuring a temperature of said safety pipe system proximate said safety device, and an interlocking means operable when said flow switch detects processing gas being spouted from said safety pipe system and any one of the temperature signals from said first, second and third thermocouples exceeds a preset value for closing said first and third opening and closing valves, opening said second opening and closing valve, stopping operation of said gas compressor and disconnecting a power source for said furnace in said high pressure vessel.

8. An interlocking device for a hot isostatic pressurizing equipment which includes a gas cylinder, a gas compressor, a high pressure vessel, a furnace in said high pressure vessel, a processing gas pipe system for supplying processing gas from said gas cylinder to said high pressure vessel by way of said gas compressor, a relief pipe system connected to said processing gas pipe system between said gas compressor and said high pressure vessel for relieving a pressure to the atmospheric air, a safety system connected to said processing gas pipe system between said gas compressor and said high pressure vessel and having a safety device for being burst, when the pressure within said high pressure vessel rises higher than a predetermined level, to relieve the pressure, and a first opening and closing valve interposed in said processing gas pipe system, comprising a processing gas sampling pipe connected to said processing gas pipe system between said gas cylinder and said gas compressor, an oxygen concentration sensor provided in said processing gas sampling pipe for detecting a concentration of oxygen in processing gas, a supply side interlocking means operable when said oxygen concentration sensor detects an oxygen concentration higher than a predetermined level for closing said first opening and closing valve in said processing gas pipe system and disconnecting a power source for said furnace in said high pressure vessel, a second opening and closing valve provided in said processing gas pipe system between said gas cylinder and said gas compressor, a third opening and closing valve interposed in said relief pipe system, a fourth opening and closing valve interposed in said safety pipe system, a flow switch provided in said safety pipe system for detecting processing gas being spouted from said safety pipe system when the pressure in said high pressure vessel falls lower than the predetermined pressure after said safety device has been burst, and a relief side interlocking means operable when said flow switch detects processing gas being spouted from said safety pipe system for closing said second and fourth opening and closing valves, opening said third opening and closing valve, stopping operation of said gas compressor and disconnecting a power source for said furnace in said high pressure vessel.

9. An interlocking device for a hot isostatic pressurizing equipment which includes a gas cylinder, a gas compressor, a high pressure vessel, a furnace in said high pressure vessel, a processing gas pipe system for supplying processing gas from said gas cylinder to said high pressure vessel by way of said gas compressor, a relief pipe system connected to said processing gas pipe system between said gas compressor and said high pressure vessel for relieving a pressure to the atmospheric air, a safety pipe system connected to said processing gas pipe system between said gas compressor and said high pressure vessel and having a safety device for being burst, when the pressure within said high pressure vessel rises higher than a predetermined level, to relieve the pressure, and a first opening and closing valve interposed in said processing gas pipe system, comprising a processing gas sampling pipe connected to said processing gas pipe system between said gas cylinder and said gas compressor, an oxygen concentration sensor provided in said processing gas sampling pipe for detecting a concentration of oxygen in said processing gas, a supply side interlocking means operable when said oxygen concentration sensor detects an oxygen concentration higher than a predetermined level for closing said first opening and closing valve in said processing gas pipe system and disconnecting a power source for said furnace in said high pressure vessel, a second opening and closing valve provided in said processing gas pipe system between said gas cylinder and said gas compressor, a third opening and closing valve interposed in said relief pipe system, a fourth opening and closing valve interposed in said safety pipe system, a first thermocouple for measuring a temperature of said processing gas pipe system proximate a gas introducing port formed in a closure of said high pressure vessel, a second thermocouple for measuring a temperature of said relief pipe system proximate said third opening and closing valve, a third thermocouple for measuring a temperature of said safety pipe system proximate said safety device, and a relief side interlocking means operable when any one of the temperature signals from said first, second and third thermocouples exceeds a preset value for closing said second and fourth opening and closing valves, opening said third opening and closing valve, stopping operation of said gas compressor and disconnecting a power source for said furnace in said high pressure vessel.

10. An interlocking device for a hot isostatic pressurizing equipment which includes a gas cylinder, a gas compressor, a high pressure vessel, a furnace in said high pressure vessel, a processing gas pipe system for supplying processing gas from said gas cylinder to said high pressure vessel by way of said gas compressor, a relief pipe system connected to said processing gas pipe system between said gas compressor and said high pressure vessel for relieving a pressure to the atmospheric air, a safety pipe system connected to said processing gas pipe system between said gas compressor and said high pressure vessel and having a safety device for being burst, when the pressure within said high pressure vessel rises higher than a predetermined level, to relieve the pressure, and a first opening and closing valve interposed in said processing gas pipe system, comprising a processing gas sampling pipe connected to said processing gas pipe system between said gas cylinder and said gas compressor, an oxygen concentration sensor provided in said processing gas sampling pipe for detecting a concentration of oxygen in said processing gas, a supply side interlocking means operable when said oxygen concentration sensor detects an oxygen concentration higher than a predetermined level for closing said first opening and closing valve in said processing gas pipe system and disconnecting a power source for said furnace in said high pressure vessel, a second opening and closing valve provided in said processing gas pipe system between said gas cylinder and said gas compressor, a third opening and closing valve interposed in said relief pipe system, a fourth opening and closing valve interposed in said safety pipe system, a flow switch provided in said safety pipe system for detecting processing gas being spouted from said safety pipe system when the pressure in said high pressure vessel falls lower than the predetermined pressure after said safety device has been burst, a first thermocouple for measuring a temperature of said processing gas pipe system proximate a gas introducing port formed in a closure of said high pressure vessel, a second thermocouple for measuring a temperature of said relief pipe system proximate said third opening and closing valve, a third thermocouple for measuring a temperature of said safety pipe system proximate said safety device, and a relief side interlocking means operable when said flow switch detects processing gas being spouted from said safety pipe system and any one of the temperature signals from said first, second and third thermocouples exceeds a preset value for closing said second and fourth opening and closing valves, opening said third opening and closing valve, stopping operation of said gas compressor and disconnecting a power source for said furnace in said high pressure vessel.

11. An interlocking device for a hot isostatic pressurizing equipment which includes a first furnace for an oxygen atmosphere, a second furnace for an atmosphere other than an oxygen atmosphere, a high pressure vessel adapted to alternatively receive therein one of said first and second furnaces, a gas cylinder, a gas compressor, a processing gas pipe system for supplying processing gas from said gas cylinder to said high pressure vessel by way of said gas compressor, a relief pipe system connected to said processing gas pipe system between said gas compressor and said high pressure vessel for relieving a pressure to the atmospheric air, a safety pipe system connected to said processing gas pipe system between said gas compressor and said high pressure vessel and having a safety device for being burst, when the pressure within said high pressure vessel rises higher than a predetermined level, to relieve the pressure, and a first opening and closing valve interposed in said processing gas pipe system, comprising a processing gas sampling pipe connected to said processing gas pipe system between said gas cylinder and said gas compressor, an oxygen concentration sensor provided in said processing gas sampling pipe for detecting a concentration of oxygen in processing said gas, a discriminating circuit for distinguishing between said first and second furnaces, a supply side interlocking means operable when said oxygen concentration sensor detects an oxygen concentration higher than a predetermined level and said discriminating circuit identifies said second furnace for closing said first opening and closing valve in said processing gas pipe system and disconnecting a power source for said second furnace in said high pressure vessel, a second opening and closing valve provided in said processing gas pipe system between said gas cylinder and said gas compressor, a third opening and closing valve interposed in said relief pipe system, a fourth opening and closing valve interposed in said safety pipe system, a flow switch provided in said safety pipe system for detecting processing gas being spouted from said safety pipe system when the pressure in said high pressure vessel falls lower than the predetermined pressure after said safety device has been burst, and a relief side interlocking means operable when said flow switch detects processing gas being spouted from said safety pipe system for closing said second and fourth opening and closing valves, opening said third opening and closing valve, stopping operation of said gas compressor and disconnecting a power source for said furnace in said high pressure vessel.

12. An interlocking device for a hot isostatic pressurizing equipment which includes a first furnace for an oxygen atmosphere, a second furnace for an atmosphere other than an oxygen atmosphere, a high pressure vessel adapted to alternatively receive therein one of said first and second furnaces, a gas cylinder, a gas compressor, a processing gas pipe system for supplying processing gas from said gas cylinder to said high pressure vessel by way of said gas compressor, a relief pipe system connected to said processing gas pipe system between said gas compressor and said high pressure vessel for relieving a pressure to the atmospheric air, a safety pipe system connected to said processing gas pipe system between said gas compressor and said high pressure vessel and having a safety device for being burst, when the pressure within said high pressure vessel rises higher than a predetermined level, to relieve the pressure, and a first opening and closing valve interposed in said processing gas pipe system, comprising a processing gas sampling pipe connected to said processing gas pipe system between said gas cylinder and said gas compressor, an oxygen concentration sensor provided in said processing gas sampling pipe for detecting a concentration of oxygen in processing said gas, a discriminating circuit for distinguishing between said first and second furnaces, a supply side interlocking means operable when said oxygen concentration sensor detects an oxygen concentration higher than a predetermined level and said discriminating circuit identifies said second furnace for closing said first opening and closing valve in said processing gas pipe system and disconnecting a power source for said second furnace in said high pressure vessel, a second opening and closing valve provided in said processing gas pipe system between said gas cylinder and said gas compressor, a third opening and closing valve interposed in said relief pipe system, a fourth opening and closing valve interposed in said safety pipe system, a first thermocouple for measuring a temperature of said processing gas pipe system proximate a gas introducing port formed in a closure of said high pressure vessel, a second thermocouple for measuring a temperature of said relief pipe system proximate said third opening and closing valve, a third thermocouple for measuring a temperature of said safety pipe system proximate said safety device, and a relief side interlocking means operable when any one of the temperature signals from said first, second and third thermocouples exceeds a preset value for closing said second and fourth opening and closing valves, opening said third opening and closing valve, stopping operation of said gas compressor and disconnecting a power source for said furnace in said high pressure vessel.

13. An interlocking device for a hot isostatic pressurizing equipment which includes a first furnace for an oxygen atmosphere, a second furnace for an atmosphere other than an oxygen atmosphere, a high pressure vessel adapted to alternatively receive therein one of said first and second furnaces, a gas cylinder, a gas compressor, a processing gas pipe system for supplying processing gas from said gas cylinder to said high pressure vessel by way of said gas compressor, a relief pipe system connected to said processing gas pipe system between said gas compressor and said high pressure vessel for relieving a pressure to the atmospheric air, a safety pipe system connected to said processing gas pipe system between said gas compressor and said high pressure vessel and having a safety device for being burst, when the pressure within said high pressure vessel rises higher than a predetermined level, to relieve the pressure, and a first opening and closing valve interposed in said processing gas pipe system, comprising a processing gas sampling pipe connected to said processing gas pipe system between said gas cylinder and said gas compressor, an oxygen concentration sensor provided in said processing gas sampling pipe for detecting a concentration of oxygen in said processing gas, a discriminating circuit for distinguishing between said first and second furnaces, a supply side interlocking means operable when said oxygen concentration sensor detects an oxygen concentration higher than a predetermined level and said discriminating circuit identifies said second furnace for closing said first opening and closing valve in said processing gas pipe system and disconnecting a power source for said second furnace in said high pressure vessel, a second opening and closing valve provided in said processing gas pipe system between said gas cylinder and said gas compressor, a third opening and closing valve interposed in said relief pipe system, a fourth opening and closing valve interposed in said safety pipe system, a flow switch provided in said safety pipe system for detecting processing gas being spouted from said safety pipe system when the pressure in said high pressure vessel falls lower than the predetermined pressure after said safety device has been burst, a first thermocouple for measuring a temperature of said processing gas pipe system proximate a gas introducing port formed in a closure of said high pressure vessel, a second thermocouple for measuring a temperature of said relief pipe system proximate said third opening and closing valve, a third thermocouple for measuring a temperature of said safety pipe system proximate said safety device, and a relief side interlocking means operable when said flow switch detects processing gas being spouted from said safety pipe system and any one of the temperature signals from said first, second and third thermocouples exceeds a preset value for closing said second and fourth opening and closing valves, opening said third opening and closing valve, stopping operation of said gas compressor and disconnecting a power source for said furnace in said high pressure vessel.

* * * * *